US009090378B2

(12) United States Patent
Christiansen et al.

(10) Patent No.: US 9,090,378 B2
(45) Date of Patent: Jul. 28, 2015

(54) SHIPPING CONTAINER LOAD SECURER

(71) Applicant: Signode Industrial Group LLC, Glenview, IL (US)

(72) Inventors: David Arnold Christiansen, Vancouver, WA (US); Marc Steven Johnson, Murfreesboro, TN (US); Christopher Wayne Baker, Murfreesboro, TN (US); George C. Boyse, Rocklin, CA (US)

(73) Assignee: Signode Industrial Group LLC, Glenview, IL (US)

( * ) Notice: Subject to any disclaimer, the term of this patent is extended or adjusted under 35 U.S.C. 154(b) by 0 days.

(21) Appl. No.: 14/026,565

(22) Filed: Sep. 13, 2013

(65) Prior Publication Data

US 2014/0076760 A1 Mar. 20, 2014

Related U.S. Application Data

(60) Provisional application No. 61/702,482, filed on Sep. 18, 2012.

(51) Int. Cl.

| | |
|---|---|
| ***A63H 33/04*** | (2006.01) |
| ***B65D 19/06*** | (2006.01) |
| ***B65D 19/18*** | (2006.01) |
| ***B65D 19/14*** | (2006.01) |
| ***B65D 5/50*** | (2006.01) |

(52) U.S. Cl.

CPC ..... *B65D 19/06* (2013.01); *B65D 5/5047* (2013.01); *B65D 5/5088* (2013.01); *B65D 5/5092* (2013.01); *B65D 19/14* (2013.01); *B65D 19/18* (2013.01); *B65D 2519/00029* (2013.01); *B65D 2519/00034* (2013.01); *B65D 2519/00064* (2013.01); *B65D 2519/00069* (2013.01); *B65D 2519/0081* (2013.01); *B65D 2519/00159* (2013.01); *B65D 2519/00194* (2013.01); *B65D 2519/00497* (2013.01); *B65D 2519/00621* (2013.01); *B65D 2519/00666* (2013.01); *B65D 2519/00726* (2013.01)

(58) Field of Classification Search

CPC ..... A63H 33/04
USPC ..... 206/386, 814, 584, 585, 586, 453
See application file for complete search history.

(56) References Cited

U.S. PATENT DOCUMENTS

| | | | |
|---|---|---|---|
| 1,612,660 | A | 12/1926 | Speer |
| 1,704,948 | A | 3/1929 | Maston |
| 1,842,380 | A | 1/1932 | Andrews |
| 1,994,318 | A | 3/1935 | Loth |
| 2,363,256 | A | 11/1944 | Manning et al. |
| 2,450,801 | A | 10/1948 | Huye |
| 2,503,240 | A | 4/1950 | Cahners |
| 2,609,136 | A | 9/1952 | Sider |

(Continued)

*Primary Examiner* — Steven A. Reynolds
*Assistant Examiner* — King M Chu
(74) *Attorney, Agent, or Firm* — Neal, Gerber & Eisenberg LLP

(57) ABSTRACT

A shipping container load securer including a pallet and a box connected to the pallet and filled with a filler, wherein the pallet and the box are substantially the same size and shape as a standardized crate used to package goods for transport in shipping containers. The load securer fills voids in partially filled shipping containers, enabling the shipping container to be tightly packed and preventing the movement of goods-filled crates during transport to minimize damage to the goods in the crates in the shipping container, while not substantially increasing the weight of the container.

13 Claims, 4 Drawing Sheets

(56) References Cited

U.S. PATENT DOCUMENTS

| | | | | | |
|---|---|---|---|---|---|
| 2,643,810 | A | | 6/1953 | Fleming | |
| 2,706,935 | A | | 4/1955 | Pasjack | |
| 2,749,014 | A | | 6/1956 | Russell et al. | |
| 2,838,173 | A | | 6/1958 | Emery | |
| 2,980,573 | A | | 4/1961 | Clifford | |
| 3,039,667 | A | | 6/1962 | Kozlik | |
| 3,098,455 | A | | 7/1963 | McElroy et al. | |
| 3,131,648 | A | | 5/1964 | Seger | |
| 3,145,853 | A | | 8/1964 | Langenberg | |
| 3,174,887 | A | | 3/1965 | Voelker | |
| 3,220,583 | A | | 11/1965 | Robertson | |
| 3,263,830 | A | | 8/1966 | Carl | |
| 3,336,069 | A | | 8/1967 | Bayer et al. | |
| 3,385,429 | A | | 5/1968 | Becker et al. | |
| 3,405,659 | A | | 10/1968 | Hees | |
| 3,462,027 | A | | 8/1969 | Puckhaber | |
| 3,485,347 | A | | 12/1969 | Talarovich | |
| 3,580,471 | A | | 5/1971 | Burke et al. | |
| 3,581,675 | A | | 6/1971 | Kauffman | |
| 3,593,671 | A | | 7/1971 | Bramlett | |
| 3,612,301 | A | | 10/1971 | Peacock | |
| 3,618,535 | A | | 11/1971 | Hees | |
| 3,675,345 | A | * | 7/1972 | Abrams | 434/403 |
| 3,708,861 | A | * | 1/1973 | Hickey | 29/432 |
| 3,826,357 | A | | 7/1974 | Roth | |
| 3,872,799 | A | | 3/1975 | Dousset et al. | |
| 3,880,343 | A | | 4/1975 | Rockefeller | |
| 3,942,709 | A | | 3/1976 | Gepfer | |
| 3,942,837 | A | | 3/1976 | Engle | |
| 4,007,309 | A | | 2/1977 | Sewell | |
| 4,247,237 | A | | 1/1981 | Brown | |
| 4,361,264 | A | | 11/1982 | Philips | |
| 4,372,717 | A | | 2/1983 | Sewell et al. | |
| 4,386,881 | A | | 6/1983 | Liebel | |
| 4,494,897 | A | | 1/1985 | Rogers | |
| 4,516,891 | A | | 5/1985 | Wnuk et al. | |
| 4,572,716 | A | | 2/1986 | West | |
| 4,585,381 | A | | 4/1986 | Boyse | |
| 4,702,311 | A | | 10/1987 | Bizard | |
| 4,854,792 | A | | 8/1989 | Cottone | |
| 4,865,889 | A | | 9/1989 | Boyse | |
| 4,937,131 | A | | 6/1990 | Baldacci et al. | |
| 5,057,350 | A | | 10/1991 | Gezels | |
| 5,062,751 | A | | 11/1991 | Liebel | |
| D327,433 | S | | 6/1992 | Sewell | |
| 5,132,156 | A | | 7/1992 | Trassare et al. | |
| 5,139,842 | A | | 8/1992 | Sewell | |
| 5,152,647 | A | | 10/1992 | Sewell | |
| D331,014 | S | | 11/1992 | Sewell | |
| 5,161,703 | A | | 11/1992 | Patton | |
| 5,171,115 | A | | 12/1992 | McWilliams et al. | |
| 5,181,814 | A | | 1/1993 | Woods et al. | |
| 5,255,614 | A | | 10/1993 | Voss-Schrader et al. | |
| 5,282,567 | A | | 2/1994 | Dickson | |
| 5,356,251 | A | | 10/1994 | Sisco et al. | |
| 5,413,053 | A | | 5/1995 | Vannatta | |
| 5,486,078 | A | | 1/1996 | Wise | |
| 5,531,165 | A | | 7/1996 | Taravella et al. | |
| 5,704,487 | A | | 1/1998 | Taravella et al. | |
| 5,846,038 | A | | 12/1998 | Bostelman | |
| 5,855,459 | A | | 1/1999 | Krier et al. | |
| 5,952,062 | A | | 9/1999 | Clark et al. | |
| 6,190,756 | B1 | * | 2/2001 | Yokoyama et al. | 428/182 |
| 6,669,082 | B1 | | 12/2003 | Meyer | |
| 2002/0139706 | A1 | * | 10/2002 | Fujii | 206/523 |
| 2003/0010663 | A1 | * | 1/2003 | Barton et al. | 206/408 |
| 2005/0204707 | A1 | | 9/2005 | Duke et al. | |
| 2007/0193479 | A1 | * | 8/2007 | Slaats | 108/53.1 |

* cited by examiner

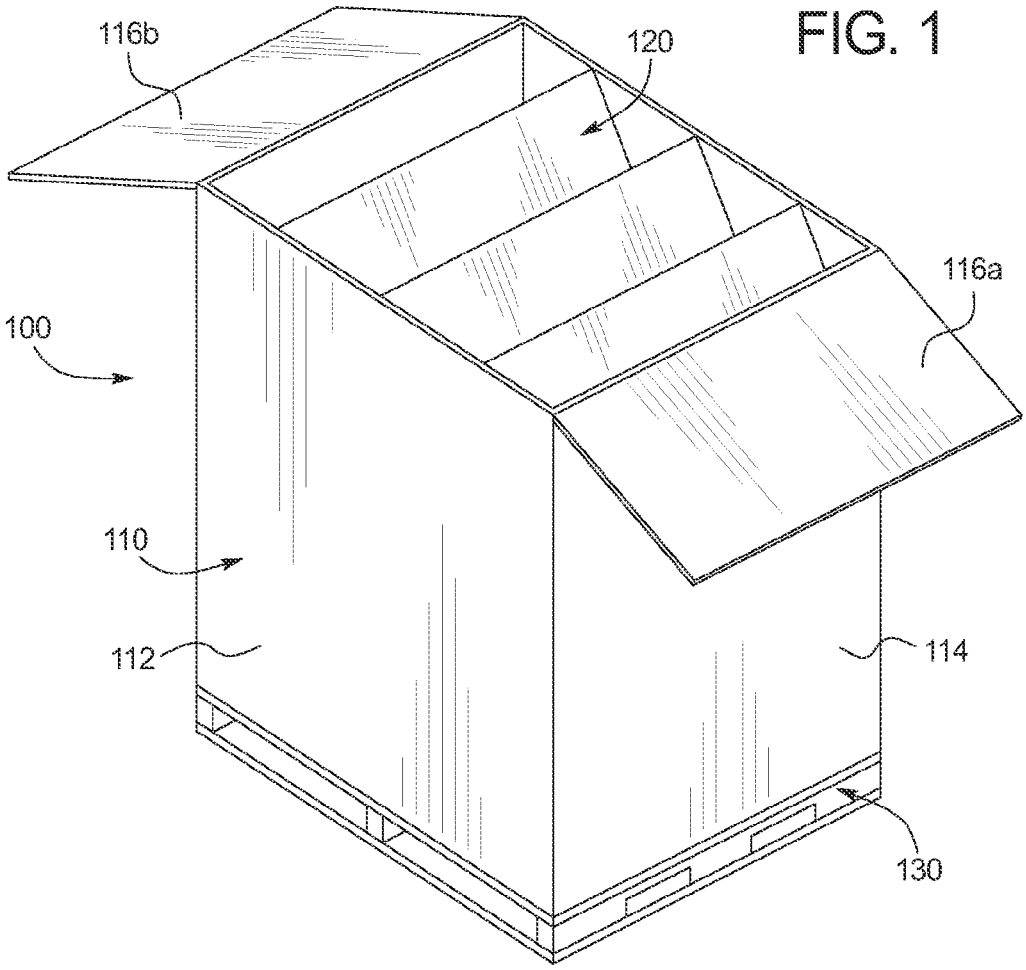
FIG. 1
FIG. 2
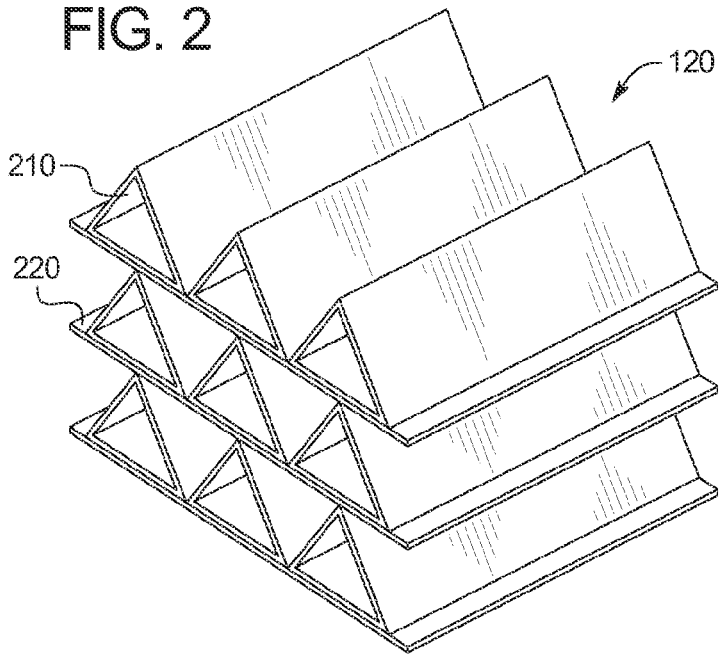

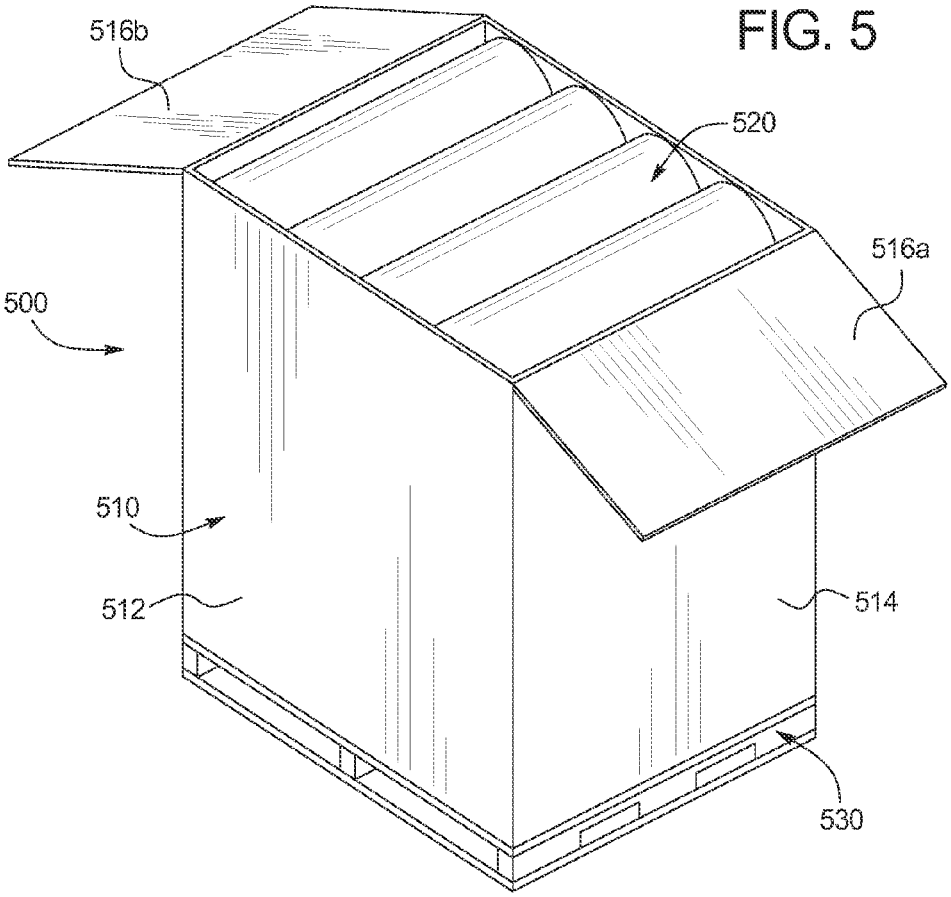
FIG. 5
FIG. 6
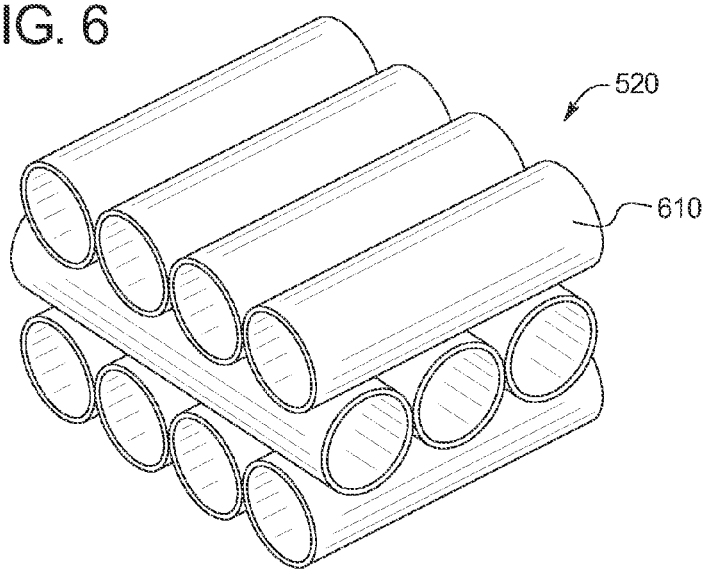

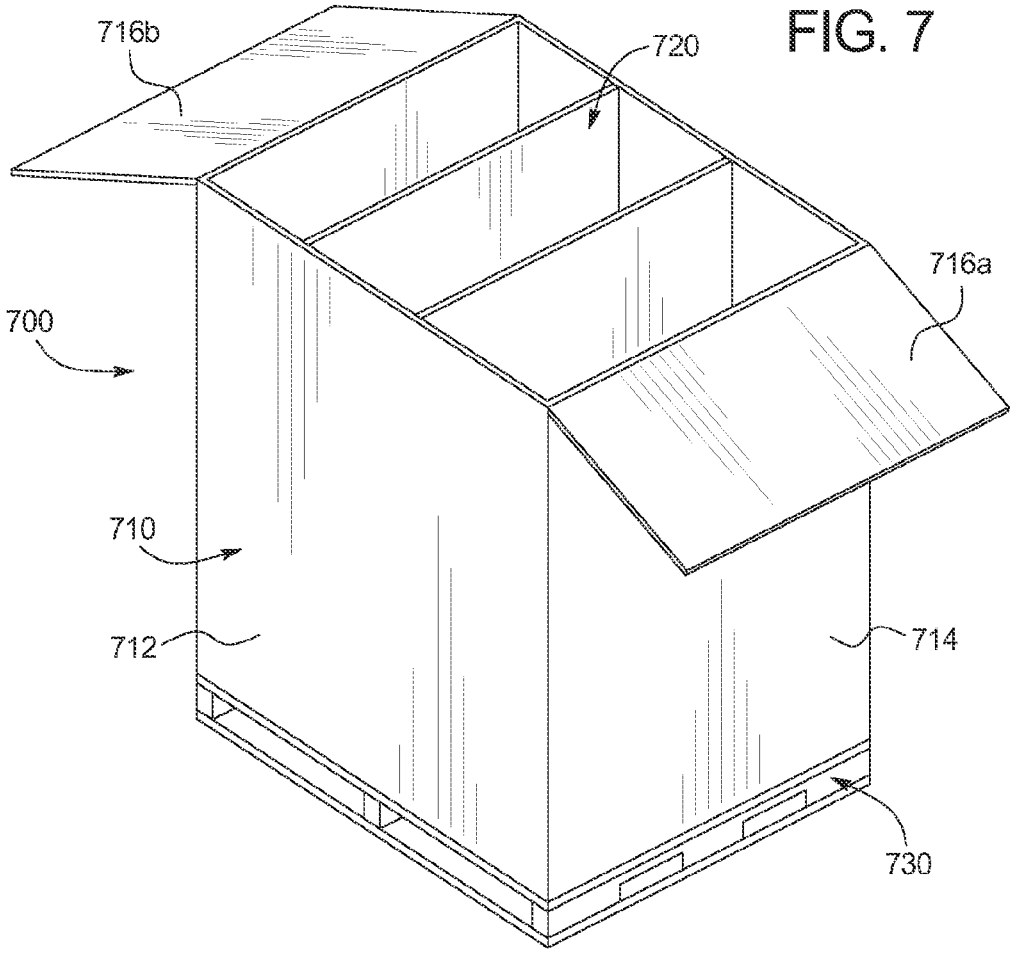
FIG. 7
FIG. 8
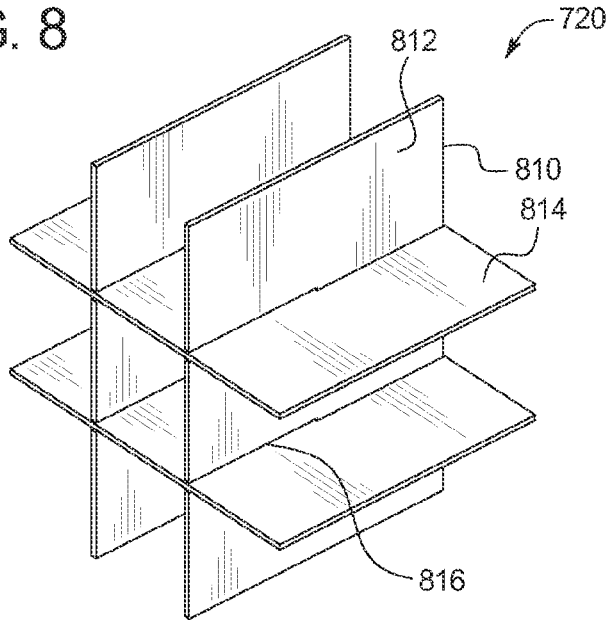

SHIPPING CONTAINER LOAD SECURER

PRIORITY CLAIM

This application claims priority to and the benefit of U.S. Provisional Patent Application Ser. No. 61/702,482, filed Sep. 18, 2012, the entire contents of which are incorporated herein by reference.

BACKGROUND

Transporting goods in shipping containers (which is sometimes referred to as containerization) has become a very popular method of transporting goods across long distances. In this transporting method, goods are loaded into a standard sized shipping container that is compatible with ocean vessels' cargo lashing systems, freight railroad car chassis, and tractor-trailers (commonly referred to as 18-wheelers in the United States). It should thus be appreciated that "shipping container" and "container" are used herein to include containers that are placed on ships, containers that are placed on railroad cars, box or freight railroad cars themselves, containers that are placed on tractor-trailers, tractor-trailer or truck containers themselves, and other suitable cargo holders. Standardization of shipping containers, with the help of specialized cargo cranes, makes the transitions between ships, freight railroad cars, and trucks relatively quick and easy, reduces the cost of getting goods to market, helps the entities in the supply chain maximize profits for the manufacture and transport of the goods, and reduces the price of goods for consumers.

Shipping containers are typically large metal boxes, and the goods are typically packed in smaller packaging such as boxes (and in particular often in gaylord boxes) to protect the goods from the container walls and from other goods and packaging packed in the shipping container. One efficient way to fill a shipping container to its maximum capacity and protect the goods therein is to pack the goods in standardized cube-shaped boxes that are attached to a pallet. This box is usually made of a corrugated material and the pallet is usually made of wood or plastic. The combination of the box and the pallet forms a shipping crate. These crates are configured so that their overall dimensions are roughly a unit fraction of the larger shipping container's corresponding dimensions. In this way, a forklift can pick up each of the goods-filled crates and pack the entire shipping container tightly. This tight packing of the crates against the larger container walls and neighboring crates prevents the crates from substantially shifting in the container during transport and thereby prevents the goods packaged therein from being damaged. The tight packing of the crates has the effect of lashing or securing the crates in place.

Sometimes, a shipping container is not completely filled with these crates before shipping time or not packed tightly enough for one or more reasons. One reason is that there are less good-filled crates to transport than the container can hold. Another reason is that the load reaching weight capacity or maximum load that can be placed in the container limits the number of goods-filled crates that can be placed in the container. For example, a railroad freight car may have room for 56 crates, but may reach its weight capacity with 49 goods-filled crates.

The resultant empty space in the shipping container leaves some of the crates loose and free to substantially move about inside the container during transport. These loose crates can collide with the container walls or with other crates and thus damage the goods contained therein. Goods damaged in transport cannot usually be sold at market for full price or at all; thus the time, energy, money, and fuel that went into transporting the now-damaged goods from the manufacturer to market is often somewhat or fully wasted. Manufacturers and transporters continually seek new and economical ways to secure loose crates in shipping containers to help prevent damage to goods during shipping or transport.

Certain known load or container securing systems involve constructing blocks and braces inside the container to limit the movement of loose crates in partially filled containers. Specifically, in certain known systems, lumber is used to build rigid bulkheads that fill the voids around loose containers. While this solution limits the movement of the crates, it introduces additional problems. First, this system is material intensive in that it requires the use of multiple nails and multiple pieces of lumber. Second, it is labor intensive, as it requires a worker to measure the void to be filled, locate tools, gather lumber, cut each piece of lumber to the correct size, construct the bulkhead, and position the bulkhead inside the container. This system also requires at least one worker to dismantle the lumber bulkhead when the container reaches its destination. Third, the use of untreated lumber can create an infestation problem that may require the entire shipping container (including the crates and the goods packaged therein) to be fumigated before being unloaded.

Certain other known load or container securing systems involve using various devices to secure the crates to the walls of the container. While this solution may limit the movement of crates, it also introduces additional problems. First, these devices are susceptible to fail if the crates move or shift during transit. Second, at least one worker must enter the shipping container to install these devices. Third, at least one worker must enter the shipping container to remove these devices.

A need therefore exists to provide an economical shipping container load securing system that is complementary to the standardized crate within a larger standardized shipping container transport method so that none of the crates are left loose inside the larger shipping container during transport.

SUMMARY

Various embodiments of the present disclosure provide a shipping container load securer that prevents movement of standardized crates in a shipping container. In various embodiments, the shipping container load securer of the present disclosure includes a pallet, a closable box connected to the pallet, and a relatively strong filler positioned in the box. The shipping container load securer is often referred to herein as the load securer for brevity.

In certain embodiments, the load securer of the present disclosure provides a roughly cubic crate, wherein the overall dimensions of the connected box and pallet that form the filler-filled crate are substantially the same as a goods-filled standardized crate. In certain embodiments, the overall dimensions of the pallet and the box are a unit fraction of a larger standardized container used for long distance transport. In this way, the filler-filled crate or load securer of the present disclosure can be readily used as a place-holder to fill in gaps or empty spaces in the shipping container. In various embodiments, the filler is sufficiently strong to withstand the compression forces exerted by one or more adjacent goods-filled crates in the shipping container during transport. The present disclosure contemplates that these load securers will fill the voids of a partially-full shipping container, thus enabling tight packing of the shipping container and preventing the substantial movement of the goods-filled crates within the shipping container, while minimizing the extra weight in the shipping container. It should also be appreciated that the load securer of the present disclosure can be reused multiple times.

In certain embodiments, the box has at least one integral closure flap. In certain other embodiments, the box has a lid. In certain embodiments, the box is constructed of a corrugated material. In other embodiments, the box is constructed of a plastic or wooden material. It should be appreciated that in various alternative embodiments, any suitable type of material or combination of different types of materials (such as the types described herein) may be employed as long as such material is sufficiently durable to be used in shipping containers.

In certain embodiments, the filler includes alternating layers of triangular tubes and rigid supports. In certain other embodiments, the filler includes multiple layers of cylindrical tubes supported by spacers with semi-circular cutouts that interface with the cylindrical tubes. In certain other embodiments, the filler includes layers of cylindrical tubes arranged transversely to each other. In certain other embodiments, the filler includes a structure including interlocking rigid supports. In certain embodiments, the filler or one or more components of filler is constructed from corrugated material or pressed fiberboard. In other embodiments, the filler or one or more components of the filler is constructed of a plastic or wooden material. It should be appreciated that, in various alternative embodiments, any suitable type of filler or combination of different types of fillers (such as the types described herein) may be employed, as long as such filler exhibits sufficient strength to withstand the compression forces exerted on the crate, the box, and the filler by adjacent goods-filled crates in the shipping container during transport.

In certain embodiments, the box of the load securer is mechanically and securely or permanently attached to the pallet with fasteners such as screws, nails, staples, or by any other suitable fastening methods. In certain other embodiments, the box is securely or permanently attached to the pallet by a suitable adhesive. In certain other embodiments, the box is attached to the pallet by one or more straps after the box is filled with the filler and closed. It should be appreciated that the pallet is preferably sized to accommodate a filler-filled box that is substantially the same size as the box of a goods-filled crate.

In certain embodiments, the pallet is constructed of a wood material. In other embodiments, the pallet is constructed of a plastic or pressed fiberboard material. It should be appreciated that, in various alternative embodiments, any suitable material or combination of materials (such as the types described herein) may be employed, as long as such material is sufficiently durable to be used in shipping container.

It should be appreciated that the present disclosure contemplates that one or more load securers may need to be employed to fill the shipping container. For example, in the above example where the railroad freight car has room for 56 crates, but reaches its weight capacity with 49 goods-filled crates, 7 load securers may need to be employed. Depending on the weight, it should also be appreciated that 48 goods-filled crates and 8 load securers may need to be employed in this example to not exceed the maximum load.

Additional features and advantages of the present invention are described in, and will be apparent from, the following Detailed Description and the figures.

BRIEF DESCRIPTION OF THE DRAWINGS

FIG. 1 is a perspective view of one embodiment of the load securer of the present disclosure, and generally illustrating the pallet, box, and filler of this embodiment of the load securer.

FIG. 2 is a perspective view of the filler of the load securer of FIG. 1 shown removed from the box.

FIG. 5 is a perspective view of another embodiment of the load securer of the present disclosure, and generally illustrating the pallet, box, and filler of this embodiment of the load securer.

FIG. 6 is a perspective view of the filler of the load securer of FIG. 5 shown removed from the box.

FIG. 7 is a perspective view of another embodiment of the load securer of the present disclosure, and generally illustrating the pallet, box, and filler of this embodiment of the load securer.

FIG. 8 is a perspective view of the filler of the load securer of FIG. 7 shown removed from the box.

DETAILED DESCRIPTION

Figure 3:
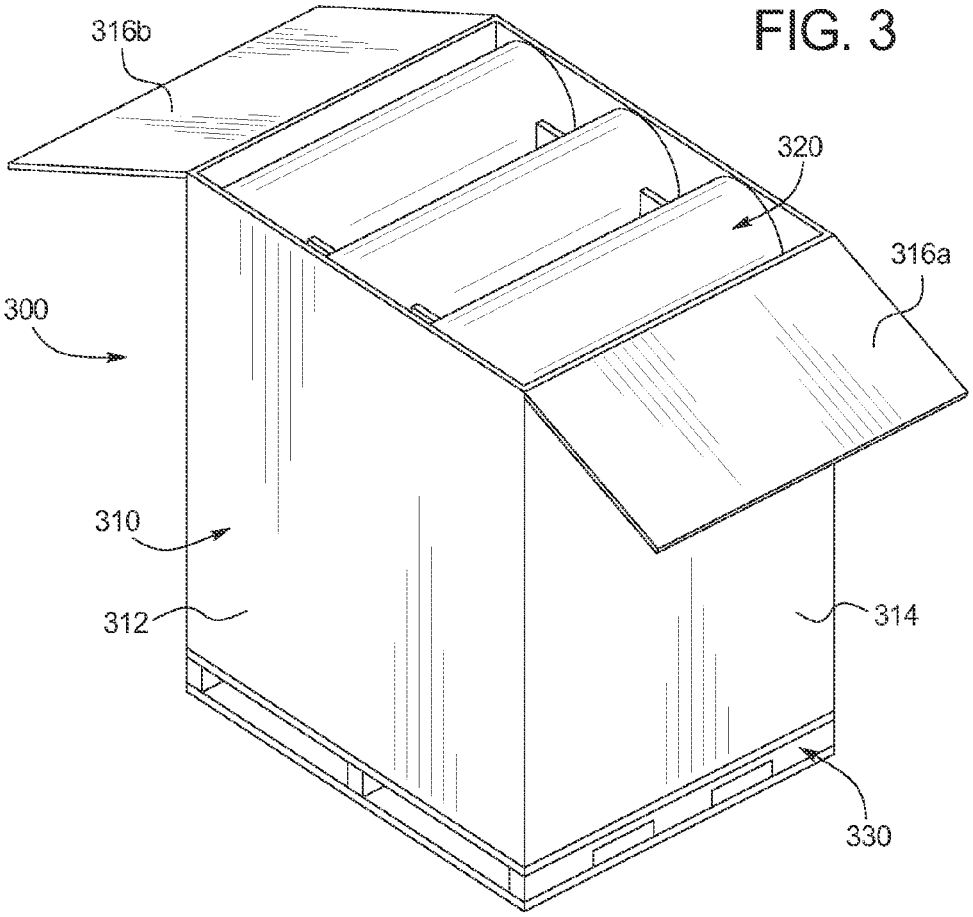
FIG. 3 is a perspective view of another embodiment of the load securer of the present disclosure, and generally illustrating the pallet, box, and filler of this embodiment of the load securer.

Referring now to the drawings, FIGS. 1 and 2 generally illustrate one example embodiment of the shipping container load securer of the present disclosure, generally indicated by numeral 100. In this illustrated example, load securer 100 includes: (a) a box 110; (b) a filler 120; and (c) a pallet 130. The box 110 in this illustrated embodiment is suitably securely or permanently attached to the pallet 130 and includes a bottom wall (not shown), a front wall 112, a back wall (not shown), a first side wall 114, a second side wall (not shown), and a top wall formed from two flap enclosures 116*a* and 116*b*. The filler 120 in this illustrated embodiment includes alternating layers of triangular tubes 210 and rigid supports 220 which are sized and configured to fill the box 110. In this illustrated example, the triangular tubes 210 are configured so that the length of each tube traverses the interior length of the box 110 and so that a plurality of triangular tubes 210 placed next to each other traverse the interior width of the box 110. In this illustrated example, the rigid supports 220 are configured so that the length of each sheet traverses the interior length of the box 110 and so that the width of each sheet traverses the interior width of the box 110. In the illustrated example, a rigid support 220 is placed in the bottom of box 110, followed by a layer of triangular tubes 220 and subsequent alternating layers of rigid supports 220 and triangular tubes 220 until the box 110 is full. After the box 110 is filled with the filler 120, closure flaps 114*a* and 114*b* are folded to close box 110 and sealed with packing tape (not shown).

In this illustrated embodiment, the pallet and box are approximately sixty inches tall, forty-eight inches wide, and forty inches deep. It should be appreciated regarding this embodiment that: (a) the pallet can be alternatively sized and configured; (b) the box can be alternatively sized and configured; (c) that the number, size, and configuration of the tubes can vary; (d) that the number, size, and configuration of the rigid supports can vary; and (e) that the materials used to form the pallet, box, and filler can vary, in accordance with the present disclosure.

Figure 4:
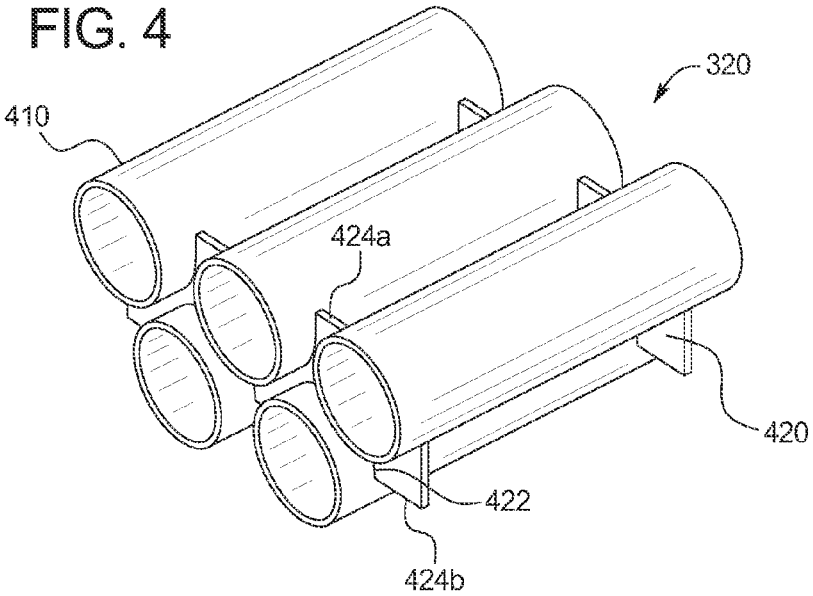
FIG. 4 is a perspective view of the filler of the load securer of FIG. 3 shown removed from the box.

Referring now to FIGS. 3 and 4, another example embodiment of a load securer of the present disclosure is illustrated, and generally indicated by numeral 300. In this illustrated example, load securer 300 includes: (a) a box 310; (b) a filler 320; and (c) a pallet 330. In this illustrated embodiment, the box 310 is suitably securely or permanently attached to the pallet 330 and includes a bottom wall (not shown), a front wall 312, a back wall (not shown), a first side wall 314, and a second side wall (not shown). In this embodiment, the filler 320 includes alternating layers of cylindrical tubes 410 and complementary spacers or supports 420 which fill the box 310. In the illustrated example, the cylindrical tubes 410 are configured so that the length of each tube traverses the interior length of the box 310. In the illustrated example, the complementary spacers or supports 420 are configured so that the length of spacer or supports traverses the interior width of the box 310 and have semicircular cutouts 422 along the upper edge 424*a* and the lower edge 424*b* to receive a plurality of evenly-spaced cylindrical tubes 410. In the illustrated example, the plurality of cylindrical tubes 410 are placed in the bottom of box 310 with even spacing between each tube, followed by at least two complementary spacers or supports 420 placed so that the semicircular cutouts 422 interface with the cylindrical tubes 410 and subsequent alternating layers of cylindrical tubes 410 and complementary spacers or supports 420 until box 310 is full. After the box 310 is filled with the filler 420, closure flaps 314*a* and 314*b* are folded to close box 310 and sealed with packing tape (not shown).

It should be appreciated regarding this embodiment that: (a) the pallet can be alternatively sized and configured; (b) the box can be alternatively sized and configured; (c) that the number, size, and configuration of the tubes can vary; (d) that the number, size, and configuration of the spacers or supports can vary; and (e) that the materials used to form the pallet, box, and filler can vary, in accordance with the present disclosure.

Referring now to FIGS. 5 and 6, another example embodiment of a load securer of the present disclosure is illustrated, and generally indicated by numeral 500. In this illustrated example, load securer 500 includes: (a) a box 510; (b) a filler 520; and (c) a pallet 530. In this illustrated embodiment, the box 510 is suitably securely or permanently attached to the pallet 530 and includes a bottom wall (not shown), a front wall 512, a back wall (not shown), a first side wall 514, and a second side wall (not shown). In this embodiment, the filler 520 includes transversely extending alternating layers of round tubes 610 which fill the box 110. In the illustrated example, the cylindrical tubes 610 are configured so that a plurality of cylindrical tubes 610 placed next to each other traverse the interior length and width of the box 510. In the illustrated example, a layer of cylindrical tubes 610 is placed in the bottom of box 510, followed by a layer of cylindrical tubes 610 placed transversely across the previous layer and subsequent alternating layers of likewise transversely alternating layers until box 510 is full. After box 510 is filled with the filler 610, closure flaps 514*a* and 514*b* are folded to close box 510 and sealed with packing tape (not shown).

It should be appreciated regarding this embodiment that: (a) the pallet can be alternatively sized and configured; (b) the box can be alternatively sized and configured; (c) that the number, size, and configuration of the tubes can vary; and (d) that the materials used to form the pallet, box, and filler can vary, in accordance with the present disclosure.

Referring now to FIGS. 7 and 8, another example embodiment of a load securer of the present disclosure is illustrated, and generally indicated by numeral 700. In this illustrated example, load securer 700 includes: (a) a box 710; (b) a filler 720; and (c) a pallet 730. In this illustrated embodiment, the box 710 is suitably securely or permanently attached to the pallet 730 and includes a bottom wall (not shown), a front wall 712, a back wall (not shown), a first side wall 714, and a second side wall (not shown). In this embodiment, the filler 720 includes a rigid structure or assembly of interlocking rigid supports 810 which fill the box 710. In this illustrated example, the vertical interlocking rigid supports 812 traverse the interior length and interior height of the box 710 and have a plurality of evenly spaced slots 816 cut halfway through their width. The plurality of slots in the vertical interlocking supports 812 is equal in number to the number of horizontal supports 814. In the illustrated example, the horizontal interlocking rigid supports 814 traverse the interior length and interior width of the box 710 and have a plurality of evenly spaced slots cut halfway through their width. The plurality of slots in the horizontal interlocking supports 814 is equal in number to the number of horizontal supports 812. In the illustrated example, a rigid structure or assembly 810 is formed by coupling or mating the vertical supports 812 with the horizontal supports 814 at their complementary and respective slots 816. After the rigid structure or assembly 810 is placed inside the box 710, closure flaps 714*a* and 714*b* are folded to close box 710 and sealed with packing tape (not shown).

It should be appreciated regarding this embodiment that: (a) the pallet can be alternatively sized and configured; (b) the box can be alternatively sized and configured; (c) that the number, size, and configuration of the supports of the structure can vary; and (d) that the materials used to form the pallet, box, and filler can vary, in accordance with the present disclosure.

It should be also be appreciated that, in various alternative embodiments, the boxes may include any suitable number of closure flaps, a lid, or any other closure may be employed, as long as such closure is sufficiently durable to be used in containerized transport.

In various embodiments, it is preferable that the boxes and the fillers have a combined compression strength of at least 2,500 pounds per square foot.

In various embodiments, the load securers are approximately 160 pounds (including the pallet, box, and filler). Compared to the goods-filled containers, these load securers are relatively light and thus do not add a significant amount of weight to the shipping containers (depending on how many load securers need to be used).

It should further be appreciated that the present disclosure contemplates that the load securer will include appropriate markings such as labels to clearly indicate that the pallet and box do not include goods and are for filling empty spaces in a shipping container. It should further be appreciated that the present disclosure contemplates that the load securer may be made of a different color or different color scheme (than goods-filled boxes) to clearly indicate that the load securer does not include goods and are for filling empty spaces in a shipping container. This will prevent users from trying to unload goods from the boxes of the load securers of the present disclosure.

It should also be appreciated that the load securer of the present disclosure can be reused multiple times, and can be shipped back to their original locations in containers. It should be appreciated that the load securers can be accumulated at a location until a full container of load securers are accumulated so that a container filled with load securers can be shipped.

It should be appreciated that when multiple load securers of the present disclosure are employed in a shipping container, that these load securers are preferably spaced apart throughout or otherwise positioned in the shipping container to even the weight of the shipping container.

It should be understood that modifications and variations may be effected without departing from the scope of the novel concepts of the present disclosure, and it should be understood that this application is to be limited only by the scope of the appended claims.

The invention is claims as follows:

1. A shipping container load securer comprising:

a pallet;

a box connected to the pallet, the box having an interior box length, an interior box width, and an interior box height; and a filler located inside the box, said filler including a plurality of sets of a plurality of triangular shaped tubes, each set of tubes having a tube set height, each tube having a tube length and a tube width, wherein, for each set of tubes, the tubes of said set are arranged such that: (a) the tube length of at least one of the tubes substantially traverses one of the interior box length and the interior box width, and (b) the tube widths of the tubes collectively substantially traverse the other of the interior box length and the interior box width, and wherein the plurality of sets of tubes are arranged such that the tube set heights of the plurality of sets of tubes collectively substantially traverse the interior box height.

2. The shipping container load securer of claim 1, wherein, for each set of tubes, the tubes of said set are attached to a support.

3. The shipping container load securer of claim 2, wherein each support is are made of one of a corrugated material, a plastic material, and a wooden material.

4. The shipping container load securer of claim 1, wherein the tubes are made of one of a corrugated material, a plastic material, and a wooden material.

5. The shipping container load securer of claim 1, wherein the box is securely connected to the pallet.

6. The shipping container load securer of claim 1, wherein the box is permanently connected to the pallet.

7. The shipping container load securer of claim 1, wherein plurality of sets of tubes are arranged such that a first set of tubes having tube lengths that substantially traverse the interior box length is above or below a second set of tubes having tube lengths that substantially traverse the interior box width.

8. The shipping container load securer of claim 1, wherein the filler includes a structure of interlocking supports.

9. The shipping container load securer of claim 8, wherein the interlocking supports are made of one of a corrugated material, a plastic material, and a wooden material.

10. The shipping container load securer of claim 1, wherein the box is made of one of a corrugated material, a plastic material, and a wooden material.

11. The shipping container load securer of claim 1, wherein the pallet is made of one of a plastic material and a wooden material.

12. The shipping container load securer of claim 1, wherein, for each set of tubes, the length of each of the tubes substantially traverses one of interior length of the box and the interior width of the box.

13. The shipping container load securer of claim 1, wherein each tube has a tube height and, for each set of tubes, the tube set height of said set is substantially equal to the tube height of the tubes of said set.

* * * * *

UNITED STATES PATENT AND TRADEMARK OFFICE

CERTIFICATE OF CORRECTION

PATENT NO. : 9,090,378 B2
APPLICATION NO. : 14/026565
DATED : July 28, 2015
INVENTOR(S) : David Arnold Christiansen et al.

It is certified that error appears in the above-identified patent and that said Letters Patent is hereby corrected as shown below:

IN THE CLAIMS

In Claim 3, Column 7, Line 28, delete “are”.
In Claim 7, Column 8, Line 5, after “wherein” insert --the--.
In Claim 12, Column 8, Line 24, between the first instance of “the” and “length” insert --tube--.
In Claim 12, Column 8, Line 25, between “interior” and “length” insert --box--.
In Claim 12, Column 8, Line 25, delete “of the box”.
In Claim 12, Column 8, Line 26, between “interior” and “width” insert --box--.
In Claim 12, Column 8, Line 26, delete “of the box”.

Signed and Sealed this
Twenty-sixth Day of April, 2016

Michelle K. Lee

Michelle K. Lee
*Director of the United States Patent and Trademark Office*